United States Patent [19]

Tominari et al.

[11] 4,418,673

[45] Dec. 6, 1983

[54] ELECTRONIC CONTROL FUEL INJECTION SYSTEM FOR SPARK IGNITION INTERNAL COMBUSTION ENGINE

[75] Inventors: Noboru Tominari, Tokyo; Takashi Ishida, Ohi, both of Japan

[73] Assignees: Mikuni Kogyo Co., Ltd.; Noboru Tominari, both of Tokyo, Japan

[21] Appl. No.: 318,867

[22] Filed: Nov. 6, 1981

[30] Foreign Application Priority Data

Nov. 28, 1980 [JP] Japan ..... 55-168361

[51] Int. Cl.[3] ..... F02M 31/00

[52] U.S. Cl. ..... 123/478; 123/480

[58] Field of Search ..... 123/478, 480, 486, 491, 123/436, 454, 444, 415, 564, 494, 360, 361, 483, 359

[56] References Cited

U.S. PATENT DOCUMENTS

| | | | |
|---|---|---|---|
| 3,575,147 | 4/1971 | Harrison et al. | 123/483 |
| 3,916,854 | 11/1975 | Barton et al. | 123/360 |
| 4,112,885 | 9/1978 | Iwata et al. | 123/359 |
| 4,205,377 | 5/1980 | Oyama et al. | 123/480 |
| 4,309,759 | 6/1982 | Tokuda et al. | 123/480 |
| 4,372,278 | 2/1983 | Smith | 123/478 |

*Primary Examiner*—Raymond A. Nelli

*Attorney, Agent, or Firm*—Stevens, Davis, Miller & Mosher

[57] ABSTRACT

An electronic control fuel injection system for a spark ignition internal combustion engine is disclosed which controls air flow rate as a function of fuel flow rate by converting an operator's depression of an accelerator pedal to an electric signal, applying the signal to a computer which preferentially determines the fuel flow rate and then the air flow rate, and feedback controlling the air flow rate by using the determined air flow rate and an actual air flow rate sensed by a pressure sensor provided at the upstream and downstream sides of a throttle valve and/or a throttle opening sensor. The computer also receives signals representative of the fuel line pressure and the air pressure in a region adjacent one or more injectors and uses this in adjusting the supply of fuel to the injector(s) to obtain a predetermined constant pressure difference thereacross. A unique digital flow control valve may also be used to precisely adjust the air flow rate. The system eliminates automobile "hesitation" while satisfying the requirements of fuel economy and low emissions.

18 Claims, 7 Drawing Figures

ELECTRONIC CONTROL FUEL INJECTION SYSTEM FOR SPARK IGNITION INTERNAL COMBUSTION ENGINE

BACKGROUND OF THE INVENTION

This invention relates to an electronic control fuel injection system for a spark ignition internal combustion engine and, more particularly, to a technique for electronically controlling the fuel injection system for controlling the air flow rate as a function of fuel flow rate.

From the advent of the internal combustion engine to recent times, a carburetor has generally been used to supply air and fuel to the combustion chamber of a spark ignition internal combustion engine. Although a carburetor is recognized as being a superior device for adjusting an air/fuel mixture from the viewpoint of its cost performance, it is too complicated to accurately perform some of the precise adjustments needed in supplying fuel to an automotive engine. Particularly, the carburetor itself is unsuited for satisfying the demands of both fuel economy and low exhaust emissions and it is typically assisted by a fluidic correcting device, an electronic correcting device or a combination of the two for providing various air/fuel mixture correcting functions.

As an improvement over the carburetor, the Bendix Corporation has developed and widely sold an electronic control fuel injection system (EFI) which utilizes modern electronic techniques to adjust the air fuel mixture. In this system, a carburetor is not used to manage the air fuel ratio, but rather an electronic circuit is used to develop a control signal representative of the air fuel ratio which meters fuel delivery with an electronic actuator. This system takes into consideration a variety of factors in order to satisfy requirements of environmental conditions, emission levels, load performance, and fuel economy. Even though more expensive than a conventional carburetor, this system is used because of its many other advantages.

However, in both a carburetor and this EFI system, the air fuel ratio of the fuel mixture supplied to the engine is controlled by an operator's depression of an accelerator pedal to open or close an intake air throttle valve attached to the engine. Both select the air flow rate by this depression, suitably detect the intake air flow rate, and determine the fuel flow rate in balance with the air flow rate. That is, the air flow rate is selected independently or preferentially as an initial value, and the fuel flow rate is then calculated as a function of the air flow rate.

It has been found that a conventional air preferential system cannot obtain both fuel consumption economy and clean combustion under all operating conditions of an engine. More specifically, it is difficult to achieve consistent fuel economy and the desired emission density because the operating mode of a throttle valve with respect to the transient operation of the engine and the fuel flow rate pattern determined according to the operating mode of the throttle valve, as well as the time history of the air fuel ratio (A/F) at any given instant, all affect fuel economy and emission density. In addition, each of these affect the driving performance of an automotive vehicle and they often interfere with each other. For this reason, it is substantially difficult to achieve compatibility among these factors. Because the air flow rate, which is selected initially by the operator, is frequency varied stepwisely as desired, and since the air density is much lower than the fuel density, a carburetor can more quickly change the air flow rate than the fuel flow rate so that the air called for at a selected air fuel ratio reaches the engine before the fuel charge associated with the selected air fuel ratio. Further, in an accelerating state of the engine, the differential pressure between the front side and the rear side of the throttle valve operating as an intake air control valve becomes large up to the time when it is stepwisely varied, so that a great deal of air flows into the throttle valve at the initial time of stepwise change of the device. Both situations result in a lean air fuel mixture. Accordingly, it is necessary to correct an excessively lean air fuel mixture ratio by adding a great deal of fuel to maintain the air fuel mixture in the combustion chamber of the engine within a combustible range. If the correction is insufficient, the automobile's driving performance deteriorates, while if the correction is excessive, fuel economy and emission density deteriorate. Thus, the amount added is very critical.

In the case of steping down the throttle (releasing the accelerator), an opposite phenomenon occurs which has similarly critical characteristics.

Because of above problems, the air flow rate preference which has been widely adopted is of doubious value, and it is accordingly now considered better to have a fuel preference system. A good comparison between the two different systems is disclosed in Paper No. 780346 of the Society of Automotive Engineers by D. L. Stivender entitled "Engine Air Control—Basis of a Vehicular Systems Control Hierarchy."

A basic fuel preference system was initially disclosed in a U.S. Pat. No. 3,771,504 entitled a "Fluidic Fuel Injection Device Having Air Modulation", and reported in Paper No. 78-WA/DSC-21 of the American Society of Mechanical Engineers (ASME) entitled "An Air Modulated Fluidic Fuel Injection System" with respect to actual experiments conducted on the system. The fundamental concept disclosed in this patent and the report is to control the air fuel ratio as a function of the fuel flow rate in a fuel preference system by carrying out the detection, computation and actuation of the system by a pneumatic and/or fluidic circuit. This system has a good cost performance when compared with a conventional carburetor.

While this system significantly improves control over the air fuel ratio, particulary during transient engine operations, since the system is essentially carried out with fluidic control, its response is somewhat slow to changing operator input, and the operating range over which adjustments in the air flow and fuel flow rate can be obtained is somewhat limited. This in turn limits the ability of the system to properly operate under all possible operating states of an engine. Also the system cannot compensate or "fine tune" the selected fuel flow rate or air flow rate to finely adjust the air fuel ratio in accordance with compensation factors determined by engine operating conditions, and cannot satisfactorily accommodate the often conflicting requirements of fuel economy and low emissions.

To overcome these shortcomings, the inventors of the present invention have proposed a system which is described in co-pending U.S. patent application entitled "ELECTRONIC CONTROL FUEL INJECTION SYSTEM FOR SPARK IGNITION INTERNAL COMBUSTION ENGINE" Ser. No. 228,973, filed on Jan. 27, 1981, and assigned to the same assignee as the present invention. The present invention relates to improvements in the invention described in this previous patent application, particularly in the areas of metering the fuel flow and air flow to the engine. For the purpose of facilitating description of the present invention an abbreviated description of the basic elements and operation of relevant portions of the system disclosed in application Ser. No. 228,973 is provided hereinbelow. However, a more complete description can be found in application Ser. No. 228,973, which is incorporated in its entirety herein by reference.

SUMMARY OF THE INVENTION

A primary object of this invention is to provide a closed loop electronic control fuel injection system for a spark ignition internal combustion engine which eliminates the drawbacks and disadvantages of conventional fuel injection systems by controlling the air flow rate to an engine as a function of the fuel flow rate.

Another object of this invention is to provide a closed loop electronic control fuel injection system for a spark ignition internal combustion engine which controls the optimum air flow rate by actuating the throttle valve according to results calculated by a computer from an operator selected fuel flow rate and various other information such as coolant temperature or engine cylinder head temperature, atmospheric temperature, atmospheric pressure, and oxidation and/or reducing catalytic temperature.

Still another object of this invention is to provide a closed loop electronic control fuel injection system for a spark ignition internal combustion engine which can control the air flow rate so that the air fuel mixture becomes rich immediately after acceleration and lean immediately after deceleration of the engine or automobile while still achieving both fuel economy and low emissions. This is achieved by selecting a proper transient air fuel mixture.

Still another object of this invention is to provide a closed loop electronic control fuel injection system for a spark ignition internal combustion engine which can significantly improve the fuel consumption and emission density even in repeated slow and steady operating states of acceleration and deceleration, as in city traffic, by rapidly controlling the air flow rate as a function of the fuel flow rate following an operator's movement of an accelerator.

Still another object of the invention is to provide a closed loop electronic control fuel injection system for a spark ignition internal combustion engine which can electronically control a fuel injection system by converting the operator's depressed stroke of an accelerator pedal to an electric signal and applying the signal to a computer or other device which calculates a fuel flow rate and appropriately actuates one or more injectors.

Still another more specific object of the invention is to provide a closed loop electronic control fuel injection system for a spark ignition internal combustion engine in which a computer or other device which calculates a fuel flow rate adjusts the supply of fuel to one or more injectors in accordance with a pressure difference existing across the injector(s).

Still another more specific object of the invention is to provide a closed loop electronic control fuel injection system for a spark ignition internal combustion engine in which a digital-type flow control valve is used to precisely meter the flow of air to the engine.

In accordance with this invention, an electronic control fuel injection system transmits an operator's depression of an accelerator pedal through a mechanical and/or electrical linkage to a fuel metering mechanism to determine the fuel flow rate, and the mechanism outputs an electric signal to a computer. The computer determines from the fuel flow rate signal the proper air flow rate to achieve an optimum air fuel ratio so that the engine may obtain an accurate operating state. Further, the system inputs to the computer a variety of information to correct the air flow rate such as, for example, coolant temperature or engine cylinder head temperature, atmospheric temperature, atmospheric pressure, oxidation and/or reducing catalytic temperature, etc. The computer is preprogrammed with data representing function relationships existing among these parameters and uses this data to correct the necessary air flow rate calculated from the fuel flow rate input. It then calculates the optimum air flow rate and produces an electric signal for determining the opening of a throttle valve and thus the air flow rate from the calculated result. The electric signal controls a throttle valve feedback servo mechanism to thereby actuate the throttle valve so as to set the optimum calculated air flow rate. The throttle valve is preferably a digital-type "on"-"-off" valve to improve the control accuracy of the air flow rate.

The computer is preferably part of a fuel supply mechanism and is used to calculate an appropriate fuel flow rate from an operator's depression of the accelerator and appropriately actuate one or more injectors to attain the calculated fuel flow rate, or the fuel supply mechanism can determine the fuel flow rate and operate one or more injectors while being separate of the computer. In either event, the fuel supply mechanism senses the pressure difference across the injector(s) and uses this parameter in adjusting the proper "on" time of the injector(s) to achieve a desired fuel flow rate.

BRIEF DESCRIPTION OF THE DRAWINGS

These and other objects, features and advantages of the invention will be seen by reference to the description, taken in connection with the accompanying drawings, in which.

DESCRIPTION OF THE PREFERRED EMBODIMENTS

Figure 1:
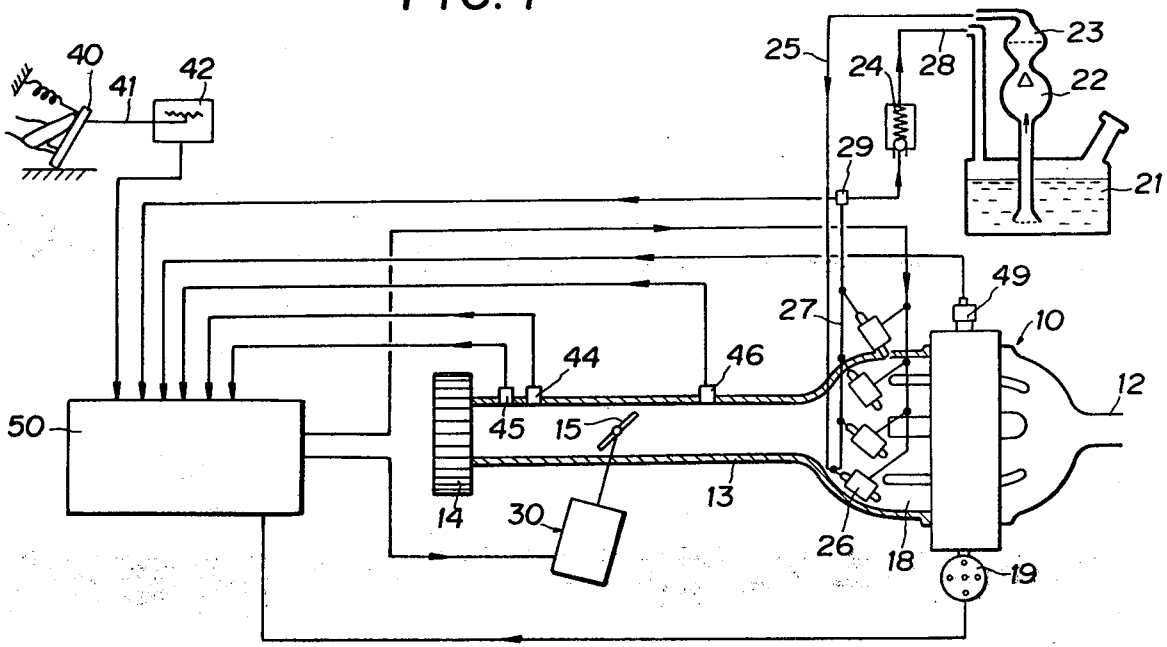
FIG. 1 shows an electronic control fuel injector system for a spark ignition internal combustion engine constructed according to this invention.

Reference is now made to the drawings, and particularly to FIG. 1 which shows one preferred embodiment of the electronic control fuel injection system of the invention for a spark ignition internal combustion engine. The electronic control fuel injection system essentially comprises six main elements: a fuel metering mechanism, a fuel supply mechanism, an air flow subsystem, a throttle servo subsystem, a control unit (computer) and a correcting element.

The construction and the operation of these elements for one embodiment of the invention will now be described in detail.

I. Fuel Metering Mechanism

The fuel metering mechanism comprises an accelerator pedal 40, an electric output signal generator 42 and a rod 41 connecting the accelerator pedal 40 to the electric output signal generator 42. The electric output signal generator 42 produces an output voltage which varies according to the depression stroke of the accelerator pedal 40 and applies it to a computer 50. As described in greater detail below, computer 50 controls the amount of fuel emitted by injectors 26 in accordance with the output voltage of signal generator 42.

II. Fuel Supply Mechanism

The fuel is supplied from a fuel tank 21 through a fuel pump 22, a filter 23 and a passage 25 into electromagnetic valve type injectors 26 attached to the intake ports 18 of the respective cylinders of the engine 10. Excessive fuel is passed from the end of an injector line 27 through a relief valve 24 and a return passage 28 back into the fuel tank 21.

Fuel pressure supplied to the fuel injectors may be kept constant by a regulator such as disclosed in Ser. No. 228,973 filed Jan. 27, 1981. However, a problem with the diaphragm fuel pressure regulator disclosed therein is its slow operation which limits its ability to maintain a desired constant fuel pressure. An improved fuel pressure regulation technique is shown in FIG. 1. The fuel pressure in the fuel supply line is always input, by a pressure sensor 29 provided in the middle of the injector lines 25 and 27 between the injectors 26 and a relief valve 24, into the computer 50 together with an intake air pressure sensed by a downstream pressure sensor 46. The control of the amount of fuel injected by injectors 26 as set by computer 50 is preferentially determined by the output of the electric output generator 42 connected to the end of the rod 41 of the accelerator pedal 40. Computer 50 also corrects the duration of the opening time of injectors 26 in accordance with pressure variances in the fuel supply line by means of the output signal from pressure sensor 29 and the output signal of air pressure sensor 46, which, when subtracted, represent the pressure difference across the injectors 26. In addition, as described further below, computer 50 calculates from the amount of fuel being suppied through the injector 26 the opening of the throttle valve needed to achieve a desired air fuel ratio. The resultant throttle opening control signal generated by computer 50 and applied to a throttle servomechanism is corrected to account for various factors such as, for example, intake air temperature, engine temperature, intake air absolute pressure and so forth.

The fuel injection amount from the respective injectors 26 is controlled by applying the output from the electric output signal generator 42 to the computer 50, which thereupon calculates the time duration of the opening of injectors 26, which is corrected by an offset amount determined by the calculated pressure difference across the injectors 26 (the subtraction of the outputs of sensor 29 and sensor 46) to achieve the desired pressure difference across the injectors. The fuel flow rate calculation can actually be performed as a table look-up function where the computer stores various fuel flow rates for various levels of output signal from generator 42. The computer may thereby merely look up a fuel flow rate in accordance with the applied output level from generator 42 and generate the necessary injector timing signals corresponding to the selected fuel flow rate. The computer also similarly stores a table of offsets required to produce the desired fuel pressure difference across the injectors 26 for various levels of actual fuel pressure differences and adjusts the injector timing signals with the proper offset amount. It is noted that when the injectors 26 are disposed upstream of the throttle valve, since a pressure sensor 44 still inputs the intake air pressure in the vicinity of the fuel injectors to the computer, the latter can still calculate a suitable fuel amount for the fuel injectors to achieve a constant pressure difference across the injectors.

The actual injector "on"–"off" control signals required to produce a calculated fuel flow rate can be formed by use of a rotating speed trigger to turn the injectors ON; by controlling the injector ON time duration while using a predetermined constant frequency control signal; by frequency modulation or the like of a constant ON time duration control signal; or by a composite of the latter two techniques.

The computer also calculates an optimum air flow rate needed to achieve a desired air fuel ratio from the determined fuel flow rate, as well as an actual air flow rate, as determined by the opening of the throttle valve and the pressure difference across the upstream and the downstream sides of the throttle valve as by pressure sensors 44 and 46. The calculation of optimum air flow rate can also be a table look-up operation in which the computer stores various rates of air flow for various rates of fuel flow, i.e. a table of air-fuel ratios, selecting the optimum air flow from the table in accordance with the calculated fuel flow rate. The difference between the calculated optimum air flow rate and the actual air flow rate is applied as a control signal to a throttle servo motor 30 which may include a stepping motor. Additional details on the operation of computer 50, including its control of servo motor 30 can be found in copending U.S. application Ser. No. 228,973 filed Jan. 27, 1981.

III. Air Flow Subsystem

Figure 3:
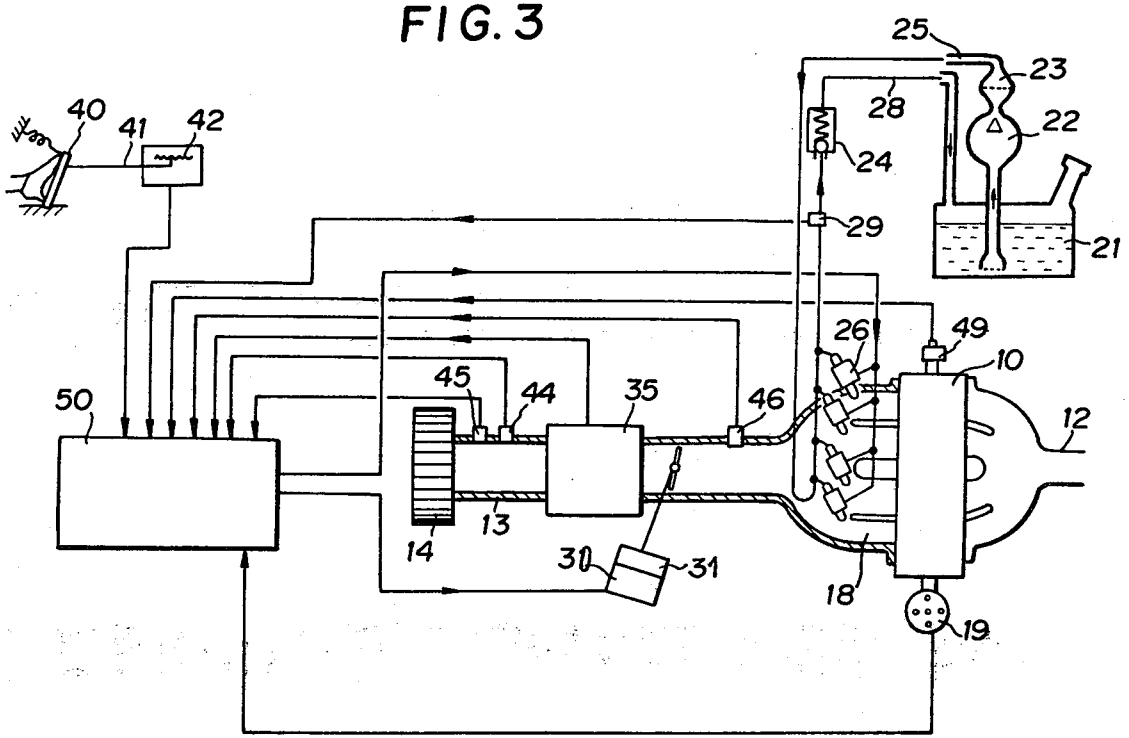
FIG. 3 shows a second modification of the air flow subsystem of the fuel injection system shown in FIG. 1.

The air flow subsystem comprises a throttle valve 15, a throttle valve upstream pressure sensor 44, and a throttle valve downstream pressure sensor 46, both of which are of the absolute pressure detecting type. Alternatively, a sensor 35 for directly detecting the pressure difference across the throttle and thus the air flow rate can be used as shown in FIG. 3.

Figure 2:
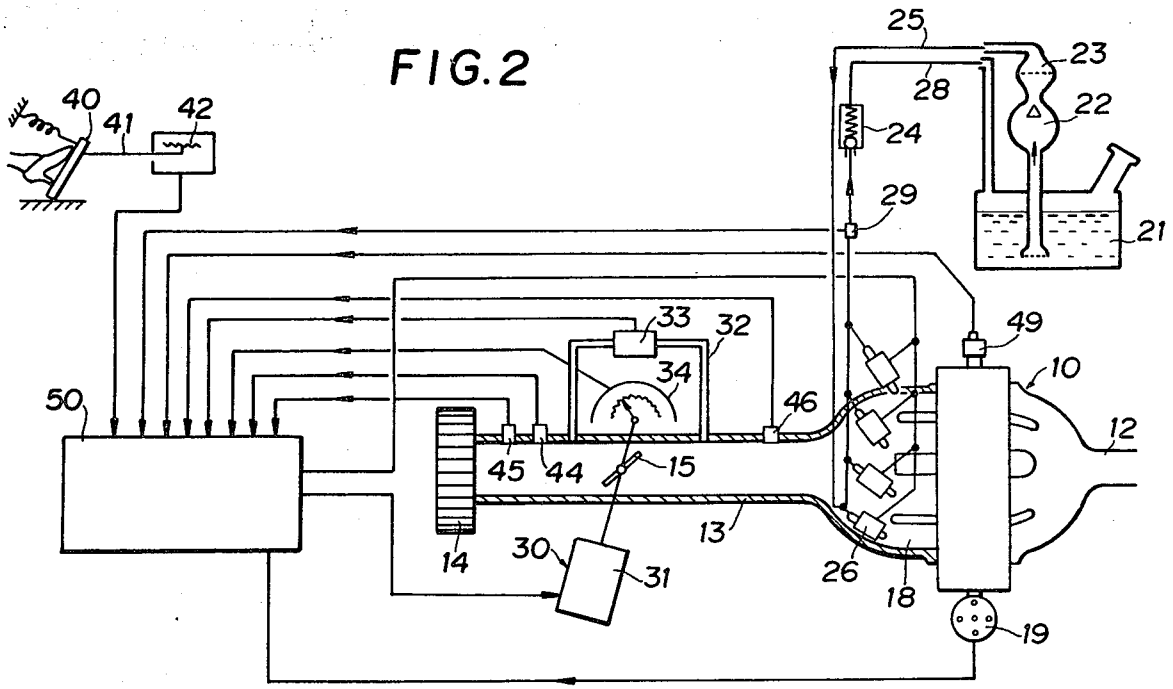
FIG. 2 shows a second modification of the air flow subsystem in the fuel injection system shown in FIG. 1.

Pressure sensors 44 and 46 detect the pressure difference in the upstream and the downstream sides of the throttle valve and also detect simultaneously the opening of the throttle valve which is set by the output signal to a throttle servo 30 from computer 50. Alternatively, the throttle opening can be determined by an encoder or a potentiometer mounted at the throttle valve, as shown in FIG. 2. Therefore, the actual air flow rate can be precisely detected by computer 50 from the pressure difference sensed by pressure sensors 44 and 46 and/or the opening of the throttle valve. This data is all fed back to the computer 50 for use in calculating the actual air flow rate which is then compared with the calculated optimum air flow rate. The computer determines the difference between these air flow rates and appropriately adjusts the output signal to throttle servo 30 to conform the actual air flow rate to the calculated optimum air flow rate.

IV. Throttle Servo Subsystem

The throttle servo subsystem may employ a stepping motor. A stepping motor can set a stepping angle of $(\frac{1}{2})^N$ knurl with gears by suitably reducing the knurl (which is the rotating angle of one step of the motor), or suitably selecting the type of drive of the stepping motor. When set in this way, the stepping motor can attain a smooth operation with a sufficiently small stepping angle. The required operation of the servo subsystem can also be suitably carried out with a linear servo or an ON/OFF servo using a DC motor.

V. Control Unit

The control unit, which is a computer, 50, described above, may consist of an analog or a digital computer, the latter comprising a microprocessor (CPU), an input-/output interface and a memory. A digital computer is particularly suitable for the table look-up calculations described above and further below. As described earlier, the computer calculates and adjusts the fuel flow rate (the injection amount) and also calculates the optimum and actual air flow rate and controls the opening of the throttle valve, the idling speed of the engine, and the like in response to the calculated fuel flow rate, setting the fuel flow rate and air flow rate at their optimum values to meet the operating state of the engine. Computer 50 also calculates the amount of air flow adjustment needed to conform the determined optimum air flow rate which would be desirable for a particular fuel flow rate with the actual air flow rate as sensed from the throttle valve opening and the basic air flow rate determined by the pressure across the throttle valve. The computer further corrects the desired air flow rate by means of the signals from the respective correction sensors such as, for example, air temperature, engine temperature, engine revolution speed, intake air absolute pressure and so forth, to determine the eventual throttle valve opening control signal for supplying an optimum air flow rate corresponding to the fuel injection amount previously determined.

VI. Correcting Element

The correcting element consists of an upstream 44 and downstream 46 pressure sensor, an intake air temperature sensor 45, the fuel supply line pressure sensor 29, an engine temperature sensor 49, and a revolution (RPM) sensor 19.

The correcting element detects in the vicinity of injectors 26 the intake air pressure in the upstream and downstream of the throttle valve and air temperature, all of which represent actual air flow. The pressure difference and throttle opening are used by the computer to calculate actual air flow as described above. The air temperature from sensor 45 may also enter into this calculation as a further refinement. The engine temperature from sensor 49 can be used to correct the calculated air flow rate to accomodate different engine temperature conditions. Fuel supply line pressure sensor 29 supplies a signal to computer 50 for adjustment of the fuel flow rate to obtain a predetermined pressure difference across the injector(s) as also described above. It is noted that when the injections 26 are disposed upstream of the throttle valve, since the pressure sensor 44 inputs the intake air pressure in the vicinity of the fuel injectors to the computer, the latter always instructs a suitable fuel amount to the fuel injectors 26 as the pressure differences across the injectors is still properly sensed.

The operation of the electronic control fuel injection system thus constructed according to this invention will now be described.

When an operator depresses the accelerator pedal 40, a signal is outputted from the electric output signal generator 42 corresponding thereto in accordance with movement of rod 41. This signal is inputted to the computer 50. The computer 50 preferentially calculates the fuel flow rate and generates varying pulse duration and/or frequency control signals which are applied to the injectors to enable the injectors to inject fuel at the finally determined fuel flow rate into intake manifold 18. This fuel flow rate calculation can be performed as a table look-up function as described above. Likewise, the injector control signal patterns corresponding to the desired fuel flow rate are stored in computer 50 and selected, or generated by computer 50, in accordance with the desired fuel flow rate. Corrections in the fuel flow rate, i.e. the injector control signal pattern, are made by the computer to achieve the desired predetermined fuel pressure difference across the injector(s). Thus, the actual fuel pressure across the injectors is determined as described earlier and the proper offset determined by the computer 50 to yield the desired fuel pressure difference. The injected fuel is mixed with intake air, and the resulting air fuel mixture is supplied to the combustion chambers of the engine 10.

The computer 50 receives a variety of information from various correction sensors, which may be in the form of a voltage, a current, a digital signal and/or a frequency signal or the like. From this information and the stored functional relationship existing among them and from the previously calculated fuel flow rate, it computes the optimum air flow rate at any given time, and outputs the results in the form of an electric signal to the stepping motor of servo mechanism 30 to thereby drive the stepping motor and obtain the necessary throttle position for the throttle valve 15. In the meantime, the pressure difference on the upstream and downstream side of the throttle valve 15 and the air temperature is always detected and applied to the computer 50, which uses it with the signal representing the position of the throttle valve simultaneously detected therewith to continuously calculate the actual air flow rate which is compared with the calculated optimum air flow rate. The difference between the actual and calculated optimum air flow rate forms an output instruction to the stepping motor to obtain a calculated throttle valve opening.

The functional relationships of all parameters which are used by computer 50 in providing an air flow control signal to servo mechanism 30, such as the pressure difference in the upstream and the downstream of the throttle valve 15, the air temperature, and the opening of the throttle valve are preset in advance in relation to various levels of a called-for fuel flow rate, and the preset air flow control signal values are stored in the memory of computer 50 such that a particular optimum air flow rate is selected in dependence on the calculated fuel flow rate and the state of the engine.

Thus, the computer 50 always refers to the stored values in the memory with respect to the signals from the differential pressure sensors 44, 46, the output to the servo motor, and the signal from the throttle valve opening detection sensor to calculate the optimum air flow and drive the servo mechanism.

As noted earlier, an independent air flow sensor (FIG. 3) may be used instead of the upstream and downstream pressure sensors. Moreover, relationships between various sensors such as, for example, between the atmospheric temperature and the intake air mass flow may also be stored in the computer 50. Correction factors for engine coolant temperature and the atmospheric pressure may also be similarly stored in the computer 50.

In lieu of a stored program/data digital computer, e.g. a microprocessor and associated interface and memory, the computer 50 can be an analog computer which computes the required air flow rate outputs by calculating analog values using an electronic circuit. For the digital computer implementation, analog signals from the various sensors may be converted through suitable analog to digital (A/D) converters into digital outputs, and digitally calculated by the computer and the digital computer outputs can be converted through suitable digital to analog (D/A) converters into an analog value to thereby drive an analog servo mechanism of the throttle servo element. If a stepping motor is used, it can be driven directly by a digital signal from computer 50 to thereby obtain a required throttle valve opening without D/A conversion or a bang-bang control can be used together with an inexpensive DC motor. The throttle valve may be readily set at a desired opening by any of these known methods.

From the idling operation to the partially loaded state of the engine, the depression of the accelerator pedal by an operator causes an increase in the output from the electric output signal generator 42 in a ratio of 1:1, however in the range where the throttle is widely opened under a heavy engine load, it is desirable if the computer limits fuel flow to a predetermined value. For this purpose, the computer receives a detected engine speed signal which is used to set the limit on the fuel flow. In an engine having, for example, a maximum of 6000 rpm, where the engine is rotated at 3000 rpm, the fuel flow rate supplied thereto becomes twice the required fuel flow rate with a full throttle instruction by the operator to thereby cause the air fuel mixture to become overenriched. As a result, it introduces abnormal engine performance with excessive high emissions. Under such conditions, the fuel discharge amount from the fuel injectors must be restricted.

To solve this problem, the computer 50 determines from the outputs from the respective sensors in the air flow subsystem or the air flow sensor and the various correction signals, that a full opening of the throttle valve is called for and suitably restricts the fuel injection amount from the fuel injectors to a predetermined value which corresponds to the engine RPM. Thus, when the throttle valve is fully opened no more fuel than necessary for an adequate air fuel ratio (A/F) is supplied to the engine. In this manner, even in any state of the engine when the throttle is widely opened due to an excessively depressed stroke of the accelerator pedal by the operator, a normal operating state can be assured for the engine. The limited fuel flow rate for various RPM values can be stored in the computer as a look-up table which is activated when a wide open throttle condition is by computer 50. A similar fuel limitation feature is also discussed in application Ser. No. 228,973 identified above.

*Starter Subsystem

No conventional mechanical starter system is needed with the invention since the computer 50 always receives detected signals from various sensors such as atmospheric pressure, air temperature, engine coolant temperature and the like and can preset the proper air fuel ratio during starting or warm up taking these factors into consideration to thereby suitably accelerate or decelerate the engine. The throttle valve for determining the air flow rate even during starting is actuated by the throttle servo with the calculated result from the computer 50. In other words, the computer 50 can be programmed to set the necessary air flow rate and air fuel ratio (A/F) without requiring any additional or separate warm up or low temperature starting mechanisms.

FIG. 2 shows another preferred embodiment of the electronic control fuel injection system constructed according to this invention, in which the pressure difference across the throttle valve is independently detected by a direct differential pressure detection sensor irrespective of the pressure detecting sensors on the upstream and the downstream sides of the throttle valve. The output of this sensor is also applied to computer 50. The pressure sensor 44 is used to correct the absolute pressure of the intake air, and the pressure sensor 46 is used to correct the pulse duration of the injectors 26 with the fuel line pressure sensor 29 as described earlier.

A potentiometer or an encoder 34 for detecting the opening of the throttle valve is also shown as being mounted at the throttle valve, and its output is fed back to the computer 50 to provide a feedback check of the angle opened by an actuator 31 in the throttle valve. In this case, the actuator may sufficiently perform its function with not only a stepping motor, but also a DC servo motor.

In case of the DC servo motor, an ON/OFF servo or digital servo may be used.

As previously noted, FIG. 3 shows still another preferred embodiment of the electronic control fuel injection system constructed according to this invention, in which the intake air flow rate is directly detected without detecting the pressure difference across the throttle valve. A conventional air flow sensor 35 for producing an electric output or a supersonic frequency variation output proportional to the intake air flow rate is independently provided.

Figure 4:
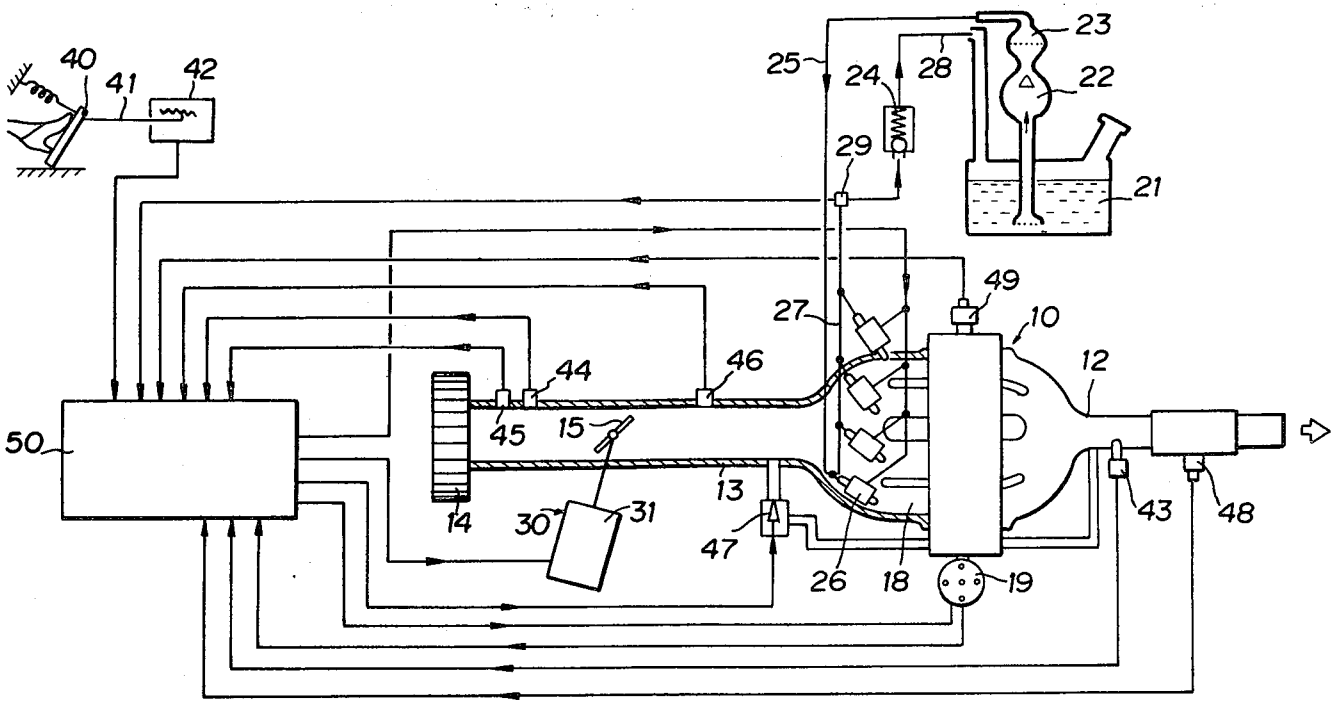
FIG. 4 shows a further modification of the fuel injection system shown in FIG. 1.

FIG. 4 shows still another preferred embodiment of the electronic control fuel injection system constructed according to this invention, in which an EGR controller valve 47, a tertiary catalytic converter temperature sensor 48 and an oxygen sensor 43 are employed for a feed-back control and a leading ignition angle control signal is produced by the computer. This can be carried out using the techniques described in detail in the above-referenced co-pending application Ser. No. 228,973 filed Jan. 27, 1981 and can apply to all the embodiments described herein.

Figure 5:
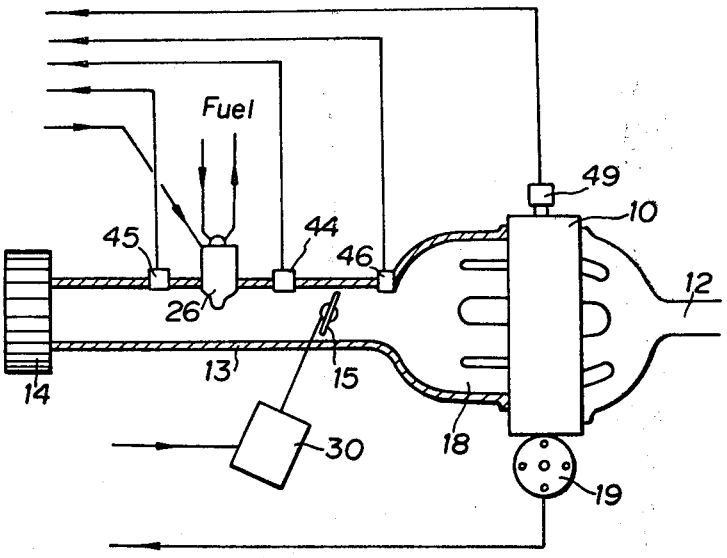
FIG. 5 shows a modification fuel supply subsystem of the fuel injection system shown in FIG. 1.

FIG. 5 shows still another preferred embodiment of the electronic control fuel injection system constructed according to this invention, in which the injector is disposed on the upstream side of the throttle valve and is a single point injector.

Figure 6:
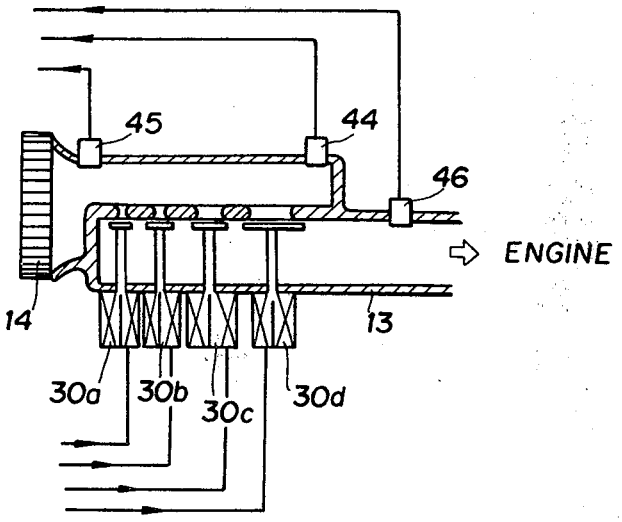
FIG. 6 shows a digital air flow control valve which may be used in the electronic control fuel injection system shown in FIG. 1.

FIG. 6 shows still another preferred embodiment of the electronic control fuel injection system constructed according to this invention, in which one or more digital (open-closed) valves 30*a* to 30*d* are used instead of the conventional circular throttle valve. In this embodiment, an operating duty (on-off) cycle of the digital valves is used to achieve a predetermined air flow rate. As shown, the controlled openings for valves 30*a* to 30*d* are progressively larger in size. Total air flow to the engine is controlled by actuating one or more of valves 30*a* to 30*d* so they open for a predetermined period of time. Both the time of opening and which valves are open determine the air flow. During operation when only a slight air flow is required, only valve 30*a* is actuated by a constant frequency variable pulse width control signal from computer 50. The amount of air supplied to the engine through the valve 30*a* is then controlled by adjusting the ON time (pulse width) of the control signal. When larger amounts of air flow are required, the computer actuates the next larger valve 30*b*, again with increasing ON times for its respective constant frequency control signal to increase the air flow. Valve 30*a* may be actuated together with valve 30*b* for fine incremental air flow adjustments. If still more air flow is required, the next larger valve 30*c* and eventually the largest valve 30*d* are actuated, each with its own constant frequency variable pulse width (ON time) control signal. By supplying one or more of valves 30*a* . . . 30*d* with respective timed ON periods, computer 50 can effectively and precisely set, a required air flow for the engine. Actuating signals for controlling valves 30*a* to 30*d* are produced by computer 50 in accordance with the calculated optimum air flow rate and the difference between it and the actual air flow rate sensed by sensors 44, 46 and 45.

As shown in FIGS. 1 and 5 a single injector 26 may be provided for all cylinders, or each cylinder may have a respective injector 26 serving it. It is also possible to use a plurality of injectors 26 each serving a group (two or more) of cylinders. In a like manner, a single throttle valve mechanism 15, 30 serving all cylinders can be used, as shown in FIGS. 1–5, or each cylinder may be served by a respective throttle valve mechanism 15, 30, or a plurality of throttle valve mechanisms 15, 30 can be used, each serving a group (two or more) of cylinders. When a plurality of injectors 26 or throttle valve mechanisms 15, are used, computer 50 may selectively operate only a predetermined number of them according to a determined operating state of the engine.

*Advantages and Effects

The electronic control fuel injection system thus constructed incorporates the following advantages:

It takes into consideration changes in the numerous parameters affecting the operating state of the engine which vary as time goes by such as speed, load, and air and fuel flow rates in establishing the running pattern of the engine. In operation, an engine is affected by repeated step ups and step downs in accordance with the depression and release of the accelerator pedal. Thus with a conventional air flow preference system a delay in the rise and fall of fuel flow rate with such changes cannot be avoided because the fuel flow rate is determined by the air flow rate variation signal after the air flow rate is determined.

Figure 7:
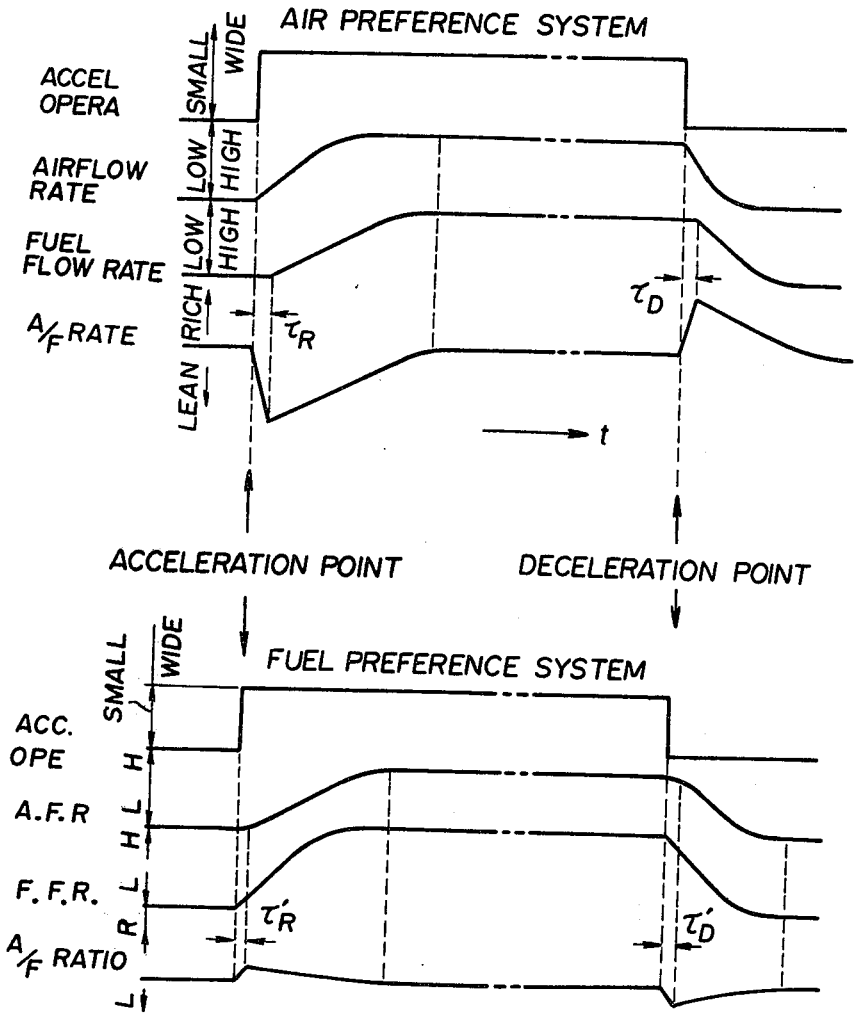
FIG. 7 is graphical representation of the characteristics of the electronic control fuel injection system of this invention.

FIG. 7 shows the characteristics of the air preference system in the upper portion. The air preference control system possesses a delay in rise of the fuel flow rate or delay time $_R$ and similarly delay time $_D$ in fall of the fuel flow rate. As a result, the air fuel ratio A/F of the air fuel mixture becomes extremely lean immediately after the engine is accelerated and becomes extremely rich immediately after the engine is decelerated as shown by the curve in the upper portion of FIG. 7. This is called the "hesitation" or "sag" of the automotive engine and is an undesired phenomena. When the delay in fall of the fuel flow rate occurs in the automotive engine, the engine exhausts detrimental gas emissions such as HC, CO, etc. with a high density. In order to remedy this undesired phenomena, an acceleration enrichment device is typically employed to correct hesitation and the delay in the closure of the throttle valve by a dash pot or an additional air bypass is employed to correct for the increased exhaust emissions.

On the other hand, the fuel preference fuel injection system of this invention adjusts the air fuel mixture so it becomes rich immediately after the engine is accelerated, and becomes lean immediately after the engine is decelerated.

In addition, since fuel has a higher density and viscosity than air, its flow resistance is high with a corresponding lag in flow in response to a stepping control of the amount thereof applied to an engine. Accordingly, the time lag of the air flowing subsequent to the fuel may suitably be controlled to meet the fuel in the engine. Therefore, the automative engine does not have the "hesitation" or "sag" and the air fuel mixture can readily attain a desired ratio even during transient periods to obtain fuel economy and a desired low emission density. These characteristics are shown in the lower portion of FIG. 7. In this case, the delay time $_{R'}$ in the rise of the air flow rate may be made to coincide with the fuel flow rate by suitably controlling the rise of the fuel flow rate. In case of decelerating the automotive engine, the characteristics may also be similarly controlled.

As obvious from the comparison of the conventional fuel injection system with the fuel preferential fuel injection system of this invention, the former system wastefully consumes fuel which is not contributing to drive the automobile particularly at its decelerating time, but the latter system reduces the fuel flow rate immediately after an operator releases the accelerator to decelerate the automobile. Even if the automotive engine consumes the same amount of fuel in its steady running state with this fuel preferential fuel injection system as compared with a conventional air preferential system, it can markedly improve the total fuel consumption when the automobile repeatedly accelerates and decelerates as in city driving and can also readily control harmful exhaust emissions.

An additional advantage of having the computer control the injectors is that a constant fuel pressure difference can be obtained across the injectors by use of a fuel line pressure feedback signal to further ensure that a precise fuel charge is delivered to the engine. An additional advantage of using a digital air flow valve is a precise control of the air supplied to the engine.

Although preferred embodiments of the invention have been shown and described they are merely exemplary of the invention. Accordingly, the invention is not limited by this description, but is only limited by the scope of the claims appended hereto.

What is claimed is:

1. An electronic control fuel injection system for an internal combustion engine for preferentially determining a fuel flow rate according to the stroke of an accelerator pedal and subordinately determining an air flow rate in response to the engine operating state comprising:

a fuel metering mechanism for selecting a fuel discharge amount in accordance with the depression stroke of an accelerator pedal and feeding said selected fuel discharge amount through an injector mechanism to said engine, an air flow sensor for detecting the intake air flow rate to said engine, a fuel pressure detector provided in a fuel supply line feeding said injector mechanism for detecting fuel pressure in said line, an air pressure detector for detecting air pressure in the vicinity of said injector mechanism, means for correcting said selected fuel discharge amount in accordance with the outputs of said fuel pressure detector and air pressure detector to achieve a predetermined fuel pressure difference across said injector mechanism, at least one engine parameter sensor, a computer receiving output signals from said fuel metering mechanism, said air flow sensor and said engine parameter sensor and determining therefrom an optimum air flow rate and producing an air flow rate control signal in accordance with a desired operating state of the engine, and a throttle valve control mechanism for setting the opening of a throttle valve of said engine in accordance with the air flow rate control signal produced by said computer.

2. The electronic control fuel injection system according to claim 1, further comprising:

a throttle valve opening detecting sensor provided at said throttle valve for supplying an output signal to said computer corresponding to the actual opening of the throttle valve, said computer using said throttle opening output signal to adjust said air flow rate control signal.

3. The electronic control fuel injection system according to claim 1, wherein a stepping motor is used as a throttle valve actuator in the throttle valve control mechanism.

4. The electronic control fuel injection system according to claim 1, wherein a DC motor is used as a throttle valve actuator in the throttle valve control mechanism.

5. The electronic control fuel injection system according to claim 1, wherein said air flow sensor directly detects the intake air flow rate to said engine.

6. The electronic control fuel injection system according to claim 1, wherein said air flow sensor includes a pair of air pressure sensors respectfully provided upstream and downstream of said throttle valve and forming a differential pressure sensor.

7. The electronic control fuel injection system according to claim 1, wherein said throttle valve comprises a plurality of on/off valves having respective different intake air flow rates for determining the air flow rate to said engine, said valves being selectively closed or opened by said air flow rate control signal to obtain a calculated air flow rate to said engine.

8. The electronic control fuel injection system according to claim 1, wherein said plurality of valves have different air flow bore sizes, which progressively increase in diameter.

9. The electronic control fuel injection system according to claim 1, wherein said fuel supply line pressure detector is arranged midway of a fuel supply line and said fuel injector mechanism, and said air pressure detector is provided in association with the injector mechanism, said two detectors supplying signals to said computer which detects an effective fuel pressure difference across said injector mechanism and corrects the opening duration of said injector mechanism in accordance with said pressure difference to attain said predetermined fuel pressure difference.

10. The electronic control fuel injection system according to claim 1, wherein said computer calculates said fuel discharge amount and appropriately actuates said injector mechanism to supply the calculated fuel discharge amount to said engine.

11. The electronic control fuel injection system according to claim 10, wherein during starting or warming up of the engine, said computer calculates said fuel discharge amount and optimum air flow rate in accordance with a stored predetermined starting or warm up operating schedule.

12. The electronic control fuel injection system according to claim 1, wherein said injector mechanism has a plurality of electromagnetic valves respectively provided for the cylinders of said engine, said electromagnetic valves being driven so as to provide said selected fuel discharge amount to said engine.

13. The electronic control fuel injection system according to claim 1, wherein the fuel control injector mechanism and the throttle valve control mechanism are commonly provided for all of the cylinders of the engine.

14. The electronic control fuel injection system according to claim 1, further comprising a fuel limiting means for limiting said fuel discharge amount independently of the depression stroke of an accelerator pedal when said engine is in a predetermined operating state.

15. An electronic control fuel injection system for an internal combustion engine for preferentially determining a fuel flow rate according to the stroke of an accelerator pedal and subordinately determining an air flow rate in response to the engine operating state comprising:

means for providing a signal representative of a depression stroke of an accelerator pedal, an air flow sensor for detecting the intake air flow rate to said engine, a fuel pressure detector provided in a fuel supply line feeding an injector mechanism for detecting the fuel pressure in said line, an air pressure detector for detecting air pressure in the vicinity of said injector mechanism, a computer receiving output signals from said signal providing means and said air flow sensor for preferentially calculating a fuel flow rate control signal and subordinately calculating an air flow rate control signal in accordance with a desired operating state of the engine, said computer adjusting said calculated fuel flow rate control signal in accordance with the subtracted outputs of said fuel and air pressure detectors, a throttle valve control mechanism for setting the opening of a throttle valve of said engine in accordance with the air flow rate control signal produced by said computer, and means supplying said fuel flow rate control signal to said injector mechanism to thereby control the fuel discharged into said engine.

16. The electronic control system according to claim 1, wherein said throttle valve comprises a plurality of bores provided in an air flow path to said engine, said bores having respective increasing diameters, and said throttle valve control mechanism comprises an electromechanical valve element respectively associated with each said bore for opening and closing it, said electromechanical valve elements being respectively actuable by control signals applied thereto such that total air flow to said engine is determined by which of said electromechanical valve elements are actuated by respective control signals and by the duration of such actuation.

17. The electronic control fuel injection system according to claim 1, wherein said injector mechanism and said throttle valve control mechanism are respectively provided for each of the cylinders of the engine and said computer selectively operates only a predetermined number of said injector and throttle valve control mechanisms according to the operating state of the engine.

18. The electronic control fuel injection system according to claim 15, wherein said injector mechanism and said throttle valve control mechanism are respectively provided for a plurality of cylinders of said engine and said computer selectively operates only a predetermined number of said injector and throttle valve control mechanisms according to the operating state of the engine.

* * * * *